US009788386B2

(12) United States Patent
Frohnapfel et al.

(10) Patent No.: US 9,788,386 B2
(45) Date of Patent: Oct. 10, 2017

(54) MELANOPIC LAMP

(71) Applicant: ZUMTOBEL LIGHTING GMBH, Dornbirn (AT)

(72) Inventors: Anja Frohnapfel, Dornbirn (AT); Birthe Tralau, Dornbirn (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 0 days.

(21) Appl. No.: 15/031,595

(22) PCT Filed: Oct. 21, 2014

(86) PCT No.: PCT/EP2014/072538

§ 371 (c)(1),
(2) Date: Apr. 22, 2016

(87) PCT Pub. No.: WO2015/059136

PCT Pub. Date: Apr. 30, 2015

(65) Prior Publication Data

US 2016/0262222 A1 Sep. 8, 2016

(30) Foreign Application Priority Data

Oct. 25, 2013 (DE) ..... 10 2013 221 723

(51) Int. Cl.
*H05B 37/02* (2006.01)
*H05B 33/08* (2006.01)

(52) U.S. Cl.
CPC ..... *H05B 33/086* (2013.01); *H05B 33/0845* (2013.01)

(58) Field of Classification Search
CPC ..... H05B 33/086; H05B 33/0845
(Continued)

(56) References Cited

U.S. PATENT DOCUMENTS 7,095,056 B2 8/2006 Vitta et al.
9,206,947 B2 12/2015 Baumgartner et al.
(Continued)

FOREIGN PATENT DOCUMENTS

AU DE 102008025864 A1 * 12/2009 ..... F21K 9/00
DE 10216645 11/2003
(Continued)

OTHER PUBLICATIONS

Baumgartner, Erwin, English Machine Translation of DE 102008025864 A1, Published Dec. 3, 2009, pp. 1-13.*
(Continued)

*Primary Examiner* — Daniel D Chang
(74) *Attorney, Agent, or Firm* — Brooks Kushman P.C.

(57) ABSTRACT

A lamp having a first light source for producing a light having a spectral distribution, wherein the light is represented by a set of chromaticity coordinates in a chromaticity diagram, and having a second light source for producing a second light having a second spectral distribution, wherein the second light is represented by a second set of coordinates in the chromaticity diagram, the second spectral distribution being different from the first spectral distribution. Furthermore, the lamp has a control unit for controlling the light sources, which control unit is designed so that an intensity of the first light can be changed independently of an intensity of the second light. By changing the intensities of the lights, the weighting of the lights can be changed so that the melanopic effect factor of the light emitted by the lamp is thereby changed without the color temperature of the light changing.

16 Claims, 2 Drawing Sheets

Figure 1:
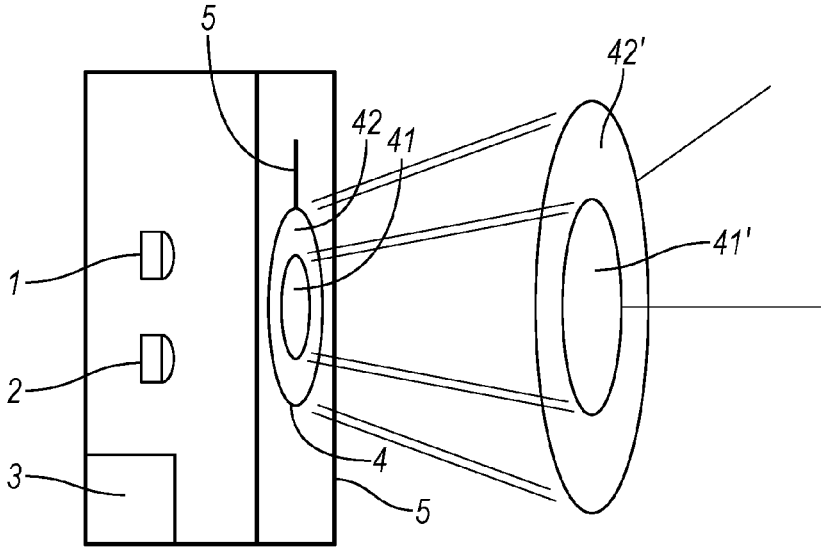

(58) Field of Classification Search
USPC ..... 315/294
See application file for complete search history.

(56) References Cited

U.S. PATENT DOCUMENTS

| | | | | |
|---|---|---|---|---|
| 2011/0176305 | A1 | 7/2011 | Schallmoser | |
| 2012/0206050 | A1 | 8/2012 | Spero | |
| 2013/0093361 | A1 | 4/2013 | Bertram et al. | |
| 2014/0184088 | A1 | 7/2014 | Lu et al. | |
| 2014/0225514 | A1* | 8/2014 | Pickard | H05B 33/0857 315/152 |
| 2016/0262222 | A1* | 9/2016 | Frohnapfel | H05B 33/0845 |

FOREIGN PATENT DOCUMENTS

| | | |
|---|---|---|
| DE | 102007043355 | 3/2009 |
| DE | 102008025864 | 12/2009 |
| DE | 102010030501 | 12/2010 |
| DE | 102010030061 | 12/2011 |
| DE | 102010039308 | 2/2012 |
| DE | 202008018269 | 6/2012 |
| EP | 1160883 | 12/2001 |
| EP | 2096351 | 9/2009 |
| WO | 0141215 | 6/2001 |
| WO | 2010003763 | 1/2010 |

OTHER PUBLICATIONS

International Search Report for PCT/EP2014/072538, English Translation attached to original, Both completed by the European Patent Office on Dec. 15, 2014, All together 7 Pages.

Austrian Search Report for Austrian Application No. GM 416/2013, Completed by the Austrian Patent Office on Dec. 30, 2014, 1 Page.

Zumtobel Apr. 24-25, 2013, Document split into 2 uploads, 1 of 2 is Original document in German, Document in German is 39 Pages, All together both documents are 79 Pages, "Anforderungen an Leuchten, Steuerungen, Bediengerate".

Zumtobel Apr. 24-25, 2013, Document split into 2 uploads, 2 of 2 is English Machine Translation to document in German, English Translation is 40 Pages, All together both documents are 79 Pages, "Requirements for lamps, Controllers, HMI Devices".

* cited by examiner

MELANOPIC LAMP

CROSS-REFERENCE TO RELATED APPLICATION

This application is the U.S. national phase of PCT application No. PCT/EP2014/072538 filed on Oct. 21, 2014, which claims priority to DE Patent Application No. 10 2013 221 723.4 filed on Oct. 25, 2013, the disclosures of which are incorporated in their entirety by reference herein.

The invention relates to a lamp comprising a first light source for generating a first light and a second light source for generating a second light, and comprising a control unit for driving the first light source and the second light source, which is designed in such a way that an intensity of the first light can be altered independently of an intensity of the second light.

The prior art discloses such a lamp, wherein a warm-white light can be generated by the first light source and a cold-white light can be generated by the second light source. The color temperature of warm-white light (e.g. 3000 K) is lower than the color temperature of cold-white light (e.g. 7000 K). Consequently, the two light sources can be driven by the control unit such that the color temperature of the light emitted overall by the lamp can be adjusted or set within specific limits.

As is known, for a human observer light is not just of importance with regard to vision, but generally also has over and above that a biological action concerning the circadian behavior of the observer. In the case of the abovementioned lamp, this last-mentioned biological action component of the light is fundamentally dependent on the color temperature of the light. The corresponding action of cold-white light—given otherwise identical conditions—is higher than that of warm-white light. The reason for this is that the cold-white light has a higher proportion of blue light than the warm-white light.

To describe the abovementioned biological action component, it is possible to use the so-called circadian action factor $A_{cv}$, which specifies the ratio of the circadian action of a light to the visual action of said light. Receptors in the human eye are of importance for the circadian action, said receptors containing the protein melanopsin and significantly influencing the time profile of the release of the hormone melatonin. Therefore, the circadian action factor is also referred to as the melanopic action factor.

Within the known lamp, therefore, the melanopic or circadian action factor of the light emitted by the lamp can be altered or adjusted by the intensities of the warm-white light and of the cold-white light being altered in opposite directions. However, this is accompanied by an alteration of the color temperature of the light—given otherwise constant conditions.

The invention is based on the object of specifying a corresponding improved lamp; in particular, the lamp is intended to be suitable for altering the circadian or melanopic action factor of the emitted light in conjunction with a constant color temperature of the light.

This object is achieved according to the invention by means of the subject matter mentioned in the independent claim. Particular types of embodiment of the invention are specified in the dependent claims.

The invention provides a lamp comprising a first light source for generating a first light having a first spectral distribution, wherein the first light is represented by a first color locus in a chromaticity diagram, and a second light source for generating a second light having a second spectral distribution, wherein the second light is represented by a second color locus in the chromaticity diagram; in this case, the second spectral distribution differs from the first spectral distribution. Furthermore, the lamp comprises a control unit for driving the first light source and the second light source, which is designed in such a way that an intensity of the first light can be altered independently of an intensity of the second light. In this case, the lamp is designed in such a way that the first color locus substantially corresponds to the second color locus.

In other words, the lamp is designed such that the first light source and the second light source are metameric light sources.

What can be achieved in this way is that, by altering the intensities of the first light and of the second light, it is possible to alter the weighting of the two lights such that the melanopic action factor of the light emitted overall by the lamp is altered as a result, without the color temperature of said light being altered in the process. In this case, what can also be achieved, in principle, is that the total intensity, composed of the intensity of the first light and of the second light, remains constant when the melanopic action factor is altered.

Preferably, in this case, the first color locus and the second color locus are localized within a seven-step MacAdam ellipse, particularly preferably within a three-step MacAdam ellipse. In this case, the color impression of the light emitted overall by the lamp can be kept practically constant in a particularly suitable manner when the melanopic action factor is altered.

Preferably, the first color locus corresponds to a first color temperature and the second color locus corresponds to a second color temperature, wherein the first color temperature differs from the second color temperature by less than 500 K. In this way, a suitable white light can be generated with the lamp. A particularly good constancy of the color impression of the light when the melanopic action factor is altered can be achieved if, in this case, the first color temperature differs from the second color temperature by less than 300 K, particularly preferably by less than 100 K.

A particularly suitable light can be achieved if the first color temperature and the second color temperature are between 2000 K and 7000 K, preferably between 3000 K and 6000 K. By way of example, approximately 4000 K can be provided, this corresponding to a neutral white.

Preferably, the lamp is designed in such a way that the first light has a first circadian action factor and the second light has a second circadian action factor, in such a way that the first circadian action factor differs from the second circadian action factor by more than 0.10, preferably by more than 0.20, particularly preferably by more than 0.30. The circadian action of the lamp can be adjusted particularly effectively in this way.

Preferably, the first light source is a first LED light source and the second light source is a second LED light source. This is advantageous both in terms of production engineering and with regard to the efficiency of the lamp.

Preferably, the first light source comprises at least one LED for generating a red light and at least one LED for generating a white light. Particularly efficient generation of the first light can be brought about in this way.

Preferably, the first light has a higher color rendering index than the second light.

Preferably, the lamp furthermore comprises a light exit region for passage of the first light and the second light. A particularly suitable superimposition or mixing of the first light with the second light can be achieved as a result.

Preferably, in this case, the lamp is designed in such a way that a size of the light exit region is variable. By altering the light exit region it is possible—given otherwise unchanged conditions—to alter the melanopic action of the light: by enlarging the light exit region it is possible, in principle, to intensify the melanopic action. Preferably, in this case, the size of the light exit region is variable at least by a factor of 2, preferably at least by a factor of 4, particularly preferably at least by a factor of 10.

Figure 2A:
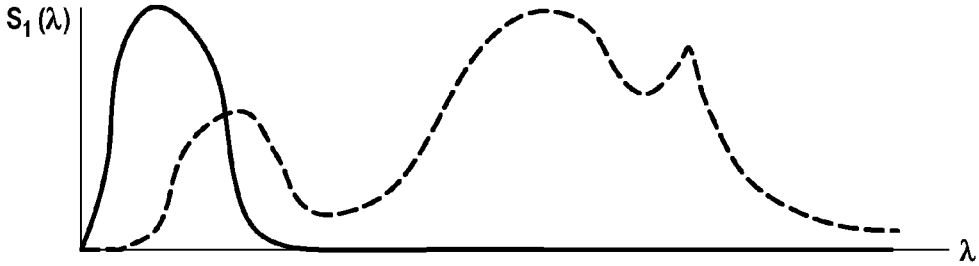
Figure 2B:
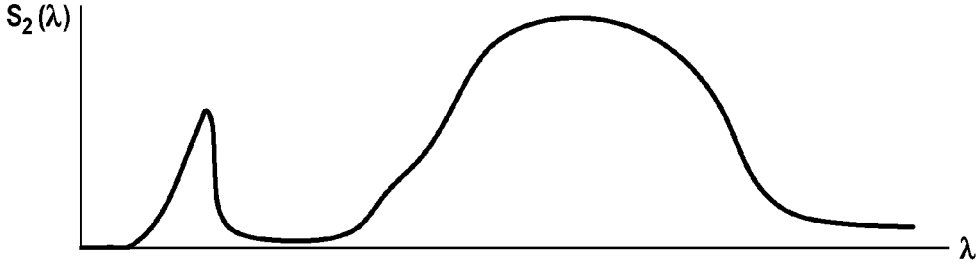
Figure 3:
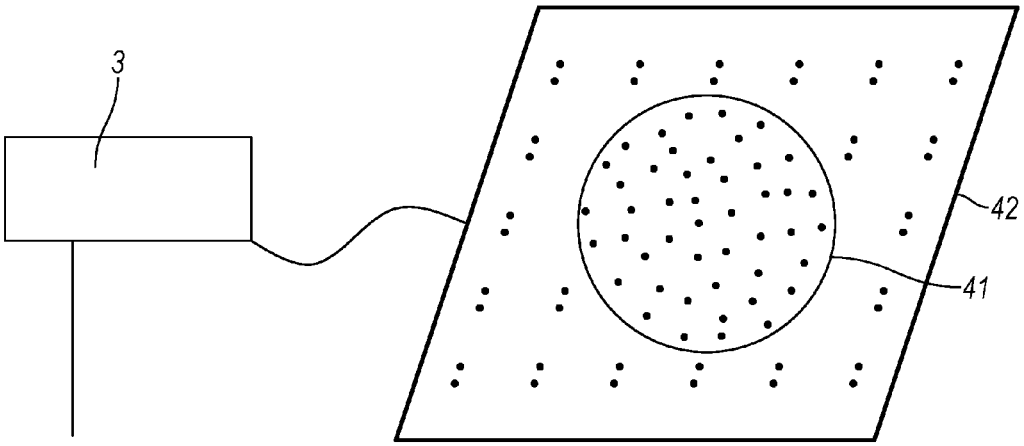
Figure 4:
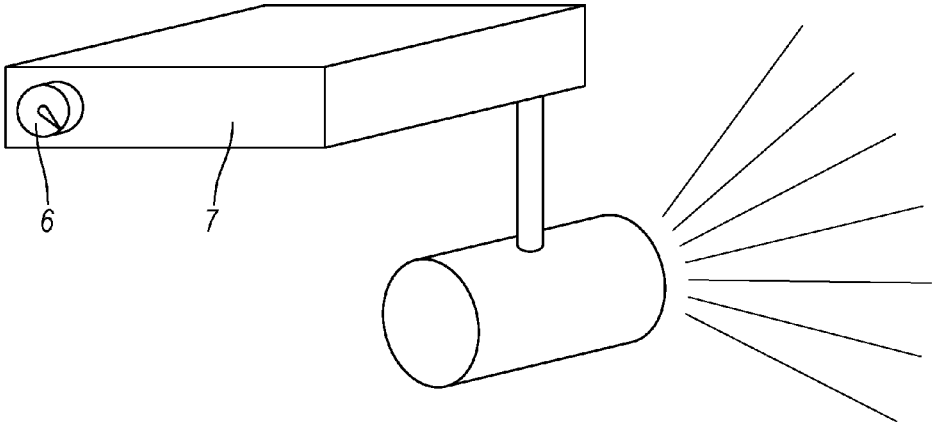

The invention is explained in greater detail below on the basis of an exemplary embodiment and with reference to the drawings, in which:

FIG. 1 shows a schematic basic diagram of one exemplary embodiment of a lamp according to the invention, FIG. 2*a* shows an example of a first spectral distribution of a first light of the lamp, FIG. 2*b* shows an example of a second spectral distribution of a second light of the lamp, FIG. 3 shows a schematic basic diagram concerning an embodiment of the lamp having a light exit region of variable size, and FIG. 4 shows a schematic basic diagram concerning an embodiment of the lamp in which the melanopic action can be adjusted by means of a rotary switch arranged on the lamp.

FIG. 1 shows a highly schematic basic diagram of one exemplary embodiment of a lamp according to the invention in the sense of a cross-sectional illustration. The lamp comprises a first light source 1 for generating a first light having a first spectral distribution, which is schematically depicted by way of example in FIG. 2*a* as a distribution $S_1(\lambda)$ as a function of the wavelength $\lambda$. In this case, the first light is represented by a first color locus F1 in a chromaticity diagram, for example in the known CIE standard chromaticity diagram from 1931.

Furthermore, the lamp comprises a second light source 2 for generating a second light having a second spectral distribution, which is schematically depicted by way of example in FIG. 2*b* as a distribution $S_2(\lambda)$ as a function of the wavelength $\lambda$. In this case, the second light is represented by a second color locus F2 in the chromaticity diagram.

In this case, the second spectral distribution $S_2(\lambda)$ differs from the first spectral distribution $S_1(\lambda)$, as is evident by way of example from the schematic diagrams in FIGS. 2*a* and 2*b*.

Provision may be made for the lamp to comprise no further light source besides the first light source 1 and the second light source 2. In particular, provision may be made for the light emitted overall by the lamp to be composed only of the first light and of the second light.

Preferably, the lamp is designed such that the first light and the second light are emitted in a manner being mutually superimposed on one another, that is to say that the light emitted overall by the lamp is formed by a mixture of the first light with the second light.

Furthermore, the lamp comprises a control unit 3 for driving the first light source 1 and the second light source 2, which is designed in such a way that an intensity of the first light can be altered independently of an intensity of the second light.

In this case, the lamp is designed in such a way that the first color locus F1 at least substantially corresponds to the second color locus F2.

What can be achieved in this way is that, by means of the control unit 3, the intensities of the first light and of the second light can be altered or adjusted such that the melanopic or circadian action factor of the light emitted overall by the lamp is altered, but the color locus remains constant in the process. Therefore, the melanopic efficacy can be adjusted, without the color impression of the emitted light changing in the process. In this case, by virtue of the two intensities mentioned being correspondingly altered in opposite directions, it is possible to alter or adjust the melanopic action of the light emitted by the lamp, without the intensity of the light emitted overall by the lamp being altered in this case. For this purpose, the control unit can be designed, in particular, to reduce the intensity of the first light and—preferably simultaneously—to increase the intensity of the second light, and preferably also correspondingly the other way round.

By way of example, the design can be such that the first color locus F1 and the second color locus F2 are localized within a seven-step MacAdam ellipse, preferably within a three-step MacAdam ellipse. As is known, a MacAdam ellipse around a reference color locus in the CIE standard chromaticity diagram from 1931 specifies that range of color loci which cannot be differentiated from the reference color locus by an "average" human observer—under specific conditions. It holds true here that color perception differs from person to person, and so a MacAdam ellipse only ever allows an approximate statement in an individual case.

To specify a distance between a color locus and a reference color locus, "steps" of MacAdam ellipses can be specified; in this case, the number of steps corresponds to a number of standard deviations—the larger the number of steps, the larger the corresponding ellipse and accordingly the more a color locus can deviate from the reference color locus. Within a one-step MacAdam ellipse, a color difference can be ascertained practically by no human being. In the case of a four-step MacAdam ellipse, a color difference is precisely perceptible to many human beings. Within a seven-step MacAdam ellipse, a color difference is discernible to most human beings.

Preferably, the first color locus F1 can correspond to a first color temperature $CCT_1$ and the second color locus F2 can correspond to a second color temperature $CCT_2$, wherein the first color temperature $CCT_1$ differs from the second color temperature $CCT_2$ by less than 500 K, preferably by less than 300 K, particularly preferably by less than 100 K. In this way, white light can be generated by the lamp.

If the first color temperature $CCT_1$ and the second color temperature $CCT_2$ are between 2000 K and 7000 K, it is possible to achieve a light emission in a preferred white hue. Preferably, the color temperature is between 3000 K and 6000 K. A "neutral" white hue can be achieved, for example, if the first and second color temperatures $CCT_1$ and $CCT_2$, respectively, are approximately 4000 K, that is to say for example between 3500 K and 4500 K. (A deviation of 100 K in this case corresponds to approximately a four-step MacAdam ellipse).

Preferably, the lamp is designed in such a way that the first light has a first circadian action factor $A_{cv1}$ and the second light has a second circadian action factor $A_{cv2}$, in such a way that the first circadian action factor $A_{cv1}$ differs from the second circadian action factor $A_{cv2}$ by more than 0.10, preferably by more than 0.20, particularly preferably by more than 0.30. The more the circadian action factor can be adjusted, the more it is possible to alter the action of the light with regard to the circadian influence on an observer. The design may indeed also be such that the circadian or melanopic action factor can be adjusted by more than 1.0.

Preferably, the first light source 1 is a first LED light source and the second light source 2 is a second LED light source. This is advantageous in terms of production engineering and with regard to the efficiency of the lamp.

By way of example, the first light source 1 can comprise at least one LED for generating a red light and at least one LED for generating a white light. The LED for generating a white light can be for example a blue LED comprising a phosphor, as is known per se and described for example in DE 10 2007 043 355 A1. The use of such an LED enables a particularly efficient light emission.

The first light generated by the first light source 1 can have a higher color rendering index than the second light generated by the second light source 2.

Furthermore, the lamp preferably comprises a light exit region 4 for passage of the first light and the second light, as intimated in the schematic diagram in FIG. 1. In this case, the lamp is preferably designed in such a way that a size of the light exit region 4 is variable. By way of example, the lamp can comprise a diaphragm 5 for this purpose, by means of which diaphragm the size of the light exit region 4 can be adjusted, in particular can be adjusted in a continuously variable manner. By way of example, provision can be made of a possibility for mechanically adjusting the size and/or an optical system for adjusting the size with a driving arrangement.

FIG. 1 shows in a manner indicated slightly in perspective, a first size 41 of the light exit surface and a second size 42 of the light exit surface 4, and also a first illuminated region 41', for example of a wall or of a floor of a room in the case of setting the first size 41 and—as an alternative thereto—a correspondingly larger second illuminated region 42' in the case of setting the second size 42.

For the melanopic action of the light, besides the spectral distribution what is of importance is the size of the areas of the two corresponding illuminated retinal regions of the observer, and also what areas within the respective retina are involved. In this case, particularly circadian or melanopic efficacy is exhibited by light which originates from the solid angle range located obliquely at the top in front of the observer and accordingly impinges on a lower portion of the two retinas, since the correspondingly effective receptors are localized in large numbers here.

If the size of the light exit region 4 can then be adjusted, the size of an illuminated region can also be altered in this way and the melanopic action can be influenced particularly effectively in this way—given conditions otherwise kept constant. Preferably, in this case, the lamp is designed such that the size of the light exit region 4 is variable at least by a factor of 2, in particular at least by a factor of 4, particularly preferably at least by a factor of 10.

FIG. 3 shows in an intimated manner—once again only highly schematically—the first size 41 of the light exit surface and the second size 42 of the light exit surface 4. Preferably, the control unit 3 can also be designed for altering the size of the light exit surface 4.

FIG. 4 schematically depicts an embodiment of the lamp in which a rotary switch 6 is arranged on a housing 7 of the lamp, by means of which rotary switch the melanopic or circadian action factor of the lamp can be adjusted. Preferably, the rotary switch 6 can be used to adjust a potentiometer serving as a constituent part of the control unit 3 for driving the two light sources 1, 2.

The lamp can be designed for example as a downlight or as a surface luminaire or as a combination thereof.

With the lamp, therefore, it is possible to realize two components that serve for altering the melanopic or circadian action of the light: firstly by means of the alteration of the spectral distribution of the light emitted overall by the lamp, and secondly by means of the size of the light exit region 4. The melanopic or circadian action of the lamp can thus be set and, if appropriate, also be driven depending on different parameters, such as, for example, time of day, season; this is also possible individually, since it is not necessary to shift the color temperature.

The invention claimed is:

1. A lamp comprising:

a first light source for generating a first light having a first spectral distribution (Si(λ)), wherein the first light is represented by a first color locus in a chromaticity diagram, a second light source for generating a second light having a second spectral distribution (S2(λ)), wherein the second light is represented by a second color locus in the chromaticity diagram, wherein the second spectral distribution (S2(λ)) differs from the first spectral distribution (S1(λ)), a control unit for driving the first light source and the second light source, which is configured such that an intensity of the first light can be altered independently of an intensity of the second light, wherein the first light source emits the first color locus which substantially corresponds to the second color locus, and the first color locus and the second color locus are localized within a seven-step MacAdam ellipse, wherein the control unit is configured to reduce the intensity of the first light and simultaneously to increase the intensity of the second light, and wherein the first light has a first circadian action factor (Acv1) and the second light has a second circadian action factor (Acv2), in such a way that the first circadian action factor (Acv1) differs from the second circadian action factor (Acv2) by more than 0.10.

2. The lamp as claimed in claim 1, wherein the first color locus corresponds to a first color temperature (CCT1) and the second color locus corresponds to a second color temperature (CCT2), wherein the first color temperature (CCT1) differs from the second color temperature (CCT2) by less than 500 K.

3. The lamp as claimed in claim 2, wherein the first color temperature (CCT1) and the second color temperature (CCT2) are between 2000 K and 7000K.

4. The lamp as claimed in claim 2, wherein the first color temperature (CCT1) and the second color temperature (CCT2) are between 3000 K and 6000K.

5. The lamp as claimed in claim 1, wherein the first light source is a first LED light source and the second light source is a second LED light source.

6. The lamp as claimed claim 1, wherein the first light source comprises at least one LED for generating a red light and at least one LED for generating a white light.

7. The lamp as claimed in claim 1, wherein the first light has a higher color rendering index than the second light.

8. The lamp as claimed in claim 1, wherein the first color locus and the second color locus are localized within a three-step MacAdam ellipse.

9. The lamp as claimed in claim 1, wherein the first color locus corresponds to a first color temperature (CCT1) and the second color locus corresponds to a second color temperature (CCT2), wherein the first color temperature (CCT1) differs from the second color temperature (CCT2) by less than 300 K.

10. The lamp as claimed in claim 1, wherein the first color locus corresponds to a first color temperature (CCT1) and the second color locus corresponds to a second color temperature (CCT2), wherein the first color temperature (CCT1) differs from the second color temperature (CCT2) by less than 100 K.

11. A lamp comprising:

a first light source for generating a first light having a first spectral distribution (Si (λ)), wherein the first light is represented by a first color locus in a chromaticity diagram, a second light source for generating a second light having a second spectral distribution (S2(λ)), wherein the second light is represented by a second color locus in the chromaticity diagram, wherein the second spectral distribution (S2(λ)) differs from the first spectral distribution (S1(λ)), a control unit for driving the first light source and the second light source, which is configured such that an intensity of the first light can be altered independently of an intensity of the second light, wherein the first light source emits the first color locus which substantially corresponds to the second color locus, and the first color locus and the second color locus are localized within a seven-step MacAdam ellipse, wherein the control unit is configured to reduce the intensity of the first light and simultaneously to increase the intensity of the second light, and wherein the first light has a first circadian action factor (Acv1) and the second light has a second circadian action factor (Acv2), in such a way that the first circadian action factor (Acv1) differs from the second circadian action factor (Acv2) by more than 0.20.

12. A lamp comprising:

a first light source for generating a first light having a first spectral distribution (Si (λ)), wherein the first light is represented by a first color locus in a chromaticity diagram, a second light source for generating a second light having a second spectral distribution (S2(λ)), wherein the second light is represented by a second color locus in the chromaticity diagram, wherein the second spectral distribution (S2(λ)) differs from the first spectral distribution (S1(λ)), a control unit for driving the first light source and the second light source, which is configured such that an intensity of the first light can be altered independently of an intensity of the second light, wherein the first light source emits the first color locus which substantially corresponds to the second color locus, and the first color locus and the second color locus are localized within a seven-step MacAdam ellipse, wherein the control unit is configured to reduce the intensity of the first light and simultaneously to increase the intensity of the second light, and wherein the first light has a first circadian action factor (Acv1) and the second light has a second circadian action factor (Acv2), in such a way that the first circadian action factor (Acv1) differs from the second circadian action factor (Acv2) by more than 0.30.

13. A lamp comprising:

a first light source for generating a first light having a first spectral distribution (Si (λ)), wherein the first light is represented by a first color locus in a chromaticity diagram, a second light source for generating a second light having a second spectral distribution (S2(λ)), wherein the second light is represented by a second color locus in the chromaticity diagram, wherein the second spectral distribution (S2(λ)) differs from the first spectral distribution (S1(λ)), a control unit for driving the first light source and the second light source, which is configured such that an intensity of the first light can be altered independently of an intensity of the second light, wherein the first light source emits the first color locus which substantially corresponds to the second color locus, and the first color locus and the second color locus are localized within a seven-step MacAdam ellipse, wherein the control unit is configured to reduce the intensity of the first light and simultaneously to increase the intensity of the second light, and a light exit region for passage of the first light and the second light, wherein a size of the light exit region is variable.

14. The lamp as claimed in claim 13, wherein the size of the light exit region is variable at least by a factor of 2.

15. The lamp as claimed in claim 13, wherein the size of the light exit region is variable at least by a factor of 4.

16. The lamp as claimed in claim 13, wherein the size of the light exit region is variable at least by a factor of 10.

* * * * *